US007363773B2

(12) United States Patent
Lee et al.

(10) Patent No.: US 7,363,773 B2
(45) Date of Patent: Apr. 29, 2008

(54) VEGETABLE ROOM FOR REFRIGERATOR

(75) Inventors: Sang-Ik Lee, Chungcheongbuk-Do (KR); Eun-Jeong Kim, Gyeongsangnam-Do (KR); Yeon-Yi Hwang, Busan (KR)

(73) Assignee: LG Electronics Inc., Seoul (KR)

( * ) Notice: Subject to any disclaimer, the term of this patent is extended or adjusted under 35 U.S.C. 154(b) by 359 days.

(21) Appl. No.: 10/532,125

(22) PCT Filed: Dec. 30, 2002

(86) PCT No.: PCT/KR02/02493

§ 371 (c)(1),
(2), (4) Date: Apr. 20, 2005

(87) PCT Pub. No.: WO2004/038311

PCT Pub. Date: May 6, 2004

(65) Prior Publication Data

US 2006/0016210 A1 Jan. 26, 2006

(30) Foreign Application Priority Data

Oct. 23, 2002 (KR) ..... 10-2002-0064972

(51) Int. Cl.
*F25D 17/04* (2006.01)

(52) U.S. Cl. ..... 62/408; 62/441

(58) Field of Classification Search ..... 62/408, 62/407, 441

See application file for complete search history.

(56) References Cited

U.S. PATENT DOCUMENTS

| | | | | |
|---|---|---|---|---|
| 2,267,486 | A | 12/1941 | West | 62/89 |
| 4,788,832 | A * | 12/1988 | Aoki et al. | 62/382 |
| 5,392,615 | A * | 2/1995 | Lim | 62/414 |
| 5,918,480 | A * | 7/1999 | Nagata et al. | 62/440 |
| 6,367,276 | B1 * | 4/2002 | Kim et al. | 62/288 |

FOREIGN PATENT DOCUMENTS

| | | |
|---|---|---|
| EP | 0248370 B1 | 7/1991 |
| GB | 2079424 | 1/1982 |
| JP | 2150682 | 6/1990 |
| JP | 11083300 | 3/1999 |

* cited by examiner

*Primary Examiner*—Melvin Jones
(74) *Attorney, Agent, or Firm*—Ked & Associates, LLP

(57) ABSTRACT

A vegetable room for a refrigerator includes: a vegetable box (20) disposed inside a refrigerator in which cooling air is supplied and circulated and which a shelf (10) for receiving food item is provided, having a receptacle space (5) for receiving food items formed to be opened upwardly; a box cover (30) for covering an opening side of the vegetable box (20) to close the receptacle space (5) of the vegetable box (20) and having a cooling air ventilating hole (31) formed at one side thereof to allow cooling air to be introduced into the receptacle space (5); and a cooling air opening and closing unit (24) for selectively opening and closing the cooling air ventilating hole (31) of the box cover (30). A preservation condition of food items stored in a vegetable room can be optimized regardless of an environment outside a refrigerator.

17 Claims, 9 Drawing Sheets

VEGETABLE ROOM FOR REFRIGERATOR

TECHNICAL FIELD

The present invention relates to a vegetable room for a refrigerator and, more particularly, to a vegetable room for a refrigerator that is capable of keeping storage stuff fresh for a long period regardless of environmental conditions outside a refrigerator.

BACKGROUND ART

In general, a refrigerator includes a freezing chamber for preserving freezing food items, a refrigerating chamber for keeping refrigerating food items, and a refrigerating cycle for supplying cooling air to the freezing chamber and the refrigerating chamber. A vegetable room is provided at a lower side of the refrigerating chamber to generally keep fruits, vegetables or functional storage items.

FIG. 1 is a vertical-sectional view showing one example of a refrigerator in accordance with a conventional art.

The conventional refrigerator includes: a main body 100 having a receptacle space therein, a freezing chamber 103 disposed at an upper portion of the main body 100 and keeping freezing items, a refrigerating chamber 109 disposed at a lower portion of the main body 100 by being partitioned from the freezing chamber 103 by a wall 105 and having a plurality of shelves 107 for receiving refrigerating food items, a freezing chamber door 111 and a refrigerating chamber door 112 respectively mounted to be opened and closed forwardly of the freezing chamber 103 and the refrigerating chamber 109; a cooing air supply unit installed at a rear side of the refrigerating chamber 103 and supplying air cooled while passing a refrigerating cycle to the freezing chamber 103 and the refrigerating chamber 109; and a vegetable room provided at a lower side of the refrigerating chamber 109 and keeping fruits, vegetables or functional storage items.

The refrigerating cycle includes a compressor 104 for changing a low temperature and low pressure gaseous refrigerant to a high temperature and high pressure gaseous refrigerant; a condenser (not shown) for condensing the gaseous refrigerant which has been compressed in the compressor 104 to a liquid state and externally discharging heat; an expander (not shown) formed as a capillary tube for changing the refrigerant in the liquid state as changed in the condenser to a low temperature and low pressure saturated liquid state; and an evaporator 106 for evaporating the refrigerant in the saturated liquid state as changed in the expander in the low temperature gas state to absorb external heat.

The cooling air supply unit includes a blow fan 115 mounted at a surface of a rear wall of the freezing chamber 103 and forcibly ventilating air cooled while passing the evaporator 106; a panel 114 disposed at a front side of the blow fan 115 and having a plurality of cooling air discharge holes 112 for supplying cooling air into the freezing chamber 103; a cooling air supply passage 117 formed penetrating the wall 105 to introduce the cooling air ventilated from the blow fan 115 to the refrigerating chamber 109; a cooling air discharge duct 118 mounted at a rear side of the refrigerating chamber 109 and communicating with the cooling air supply passage 117 to guide the cooling air supplied to the cooling air supply passage 117 into the refrigerating chamber 109; and a cooling air inlet passage 116 formed penetrating the wall 105 to allow the cooling operation-completed air after having been circulated in the refrigerating chamber 109 to be re-introduced into the evaporator 106 and cooled.

The refrigerant discharge duct 118 includes a plurality of cooling air discharge holes 119 through which cooling air is discharged into the refrigerating chamber 109.

As shown in FIG. 2, the vegetable room is configured by the lowermost shelf of the plurality of shelves 107 and a vegetable box 108 disposed at the lower side of the lowermost shelf and opened upwardly with a receptacle space with a certain volume therein.

As the vegetable box 108 is slid forwardly and backwardly at the lower side of the shelf 107, a storage stuff is received/taken away, and a space (h) is maintained between the shelf 107 and the vegetable box 108.

The operation of the conventional refrigerator will now be described.

First, when the refrigerating cycle is driven and the blow fan 115 is rotated, air is cooled while passing the refrigerating cycle and discharged to the cooling air discharge hole 112 of the panel 114 and to the cooling air supply passage 117 by the blast pressure of the blow fan 115.

The cooling air being discharged into the cooling air-discharge hole 112 circulates in the freezing chamber 103 to perform a cooling operation on the freezing food items stored in the freezing chamber 103.

The cooling air supplied to the cooling air supply passage 117 is introduced into the cooling air discharge duct 118 and then discharged into the refrigerating chamber 109 through the cooling air discharge hole 119 formed at the cooling air discharge duct 118.

The cooling air, which has been discharged into the refrigerating chamber 109, performs a cooling operation on the refrigerating food items received in the shelves 107 of the refrigerating chamber 109 and in the vegetable box 108 while circulating in the refrigerating chamber 109.

At this time, as the cooling air directly contacts with the refrigerating food items received on the shelves 107 and in the vegetable box 108, the cooling air takes the moisture from the refrigerating food items, containing more moisture, and as the cooling air is re-introduced into the refrigerating cycle through the cooling air inlet passage 116 formed at the wall 105, it is cooled again. The moisture moved along with the cooling air is congealed at the surface of the evaporator 106, is defrost in a frost-removing operation for the evaporator 106 and discharged outwardly.

Therefore, in a state that the refrigerating chamber door 113 is closed, the humidity inside the refrigerating chamber 109 is gradually lowered down due to the circulation of cooling air.

However, the conventional refrigerator has the following problems.

That is, first, since the vegetable box 108 is opened upwardly, cooling air supplied into the refrigerating chamber 109 is introduced into the space between the vegetable box 108 and the shelf 107 to directly contact with the food items in the vegetable box 108. Accordingly, for food items requiring a suitable moisture in the vegetable box 108, because their moisture would be taken away by the cooling air, freshness of the food items is degraded and storage duration is shortened.

In addition, since the vegetable box is opened upwardly, if the refrigerating chamber door is opened and closed, external air of the refrigerator can be possibly introduced into the vegetable box.

Therefore, if an environment outside the refrigerator is relatively humid, the outside moisture would be introduced into the vegetable box whenever the refrigerating chamber door is opened and closed, damping the dried food items in the vegetable box which need to be maintained dried.

Meanwhile, if the environment outside the refrigerator is relatively dry, the outside dried air would be introduced into the vegetable box whenever the refrigerating door is opened and closed, drying the food items such as fruits or vegetables in the vegetable box which need to be maintained with moisture. Then, the storage duration of the food items is shortened and freshness of the food items is degraded.

DISCLOSURE OF THE INVENTION

Therefore, an object of the present invention is to provide a vegetable room for a refrigerator that is capable of preserving food items received therein fresh for a long period by controlling cooling air introduced thereinto from a cooling air supply unit regardless of an environment outside a refrigerator.

To achieve these and other advantages and in accordance with the purpose of the present invention, as embodied and broadly described herein, there is provided a vegetable room for a refrigerator including: a vegetable box disposed inside a refrigerator in which cooling air is supplied and circulated and which a shelf for receiving food item is provided, having a receptacle space for receiving food items formed to be opened upwardly; a box cover for covering an opening side of the vegetable box to close the receptacle space of the vegetable box and having a cooling air ventilating hole formed at one side thereof to allow cooling air to be introduced into the receptacle space; and a cooling air opening and closing unit for selectively opening and closing the cooling air ventilating hole of the box cover.

The foregoing and other objects, features, aspects and advantages of the present invention will become more apparent from the following detailed description of the present invention when taken in conjunction with the accompanying drawings.

MODES FOR CARRYING OUT THE PREFERRED EMBODIMENTS

Reference will now be made in detail to the preferred embodiments of the present invention, examples of which are illustrated in the accompanying drawings.

Figure 1:
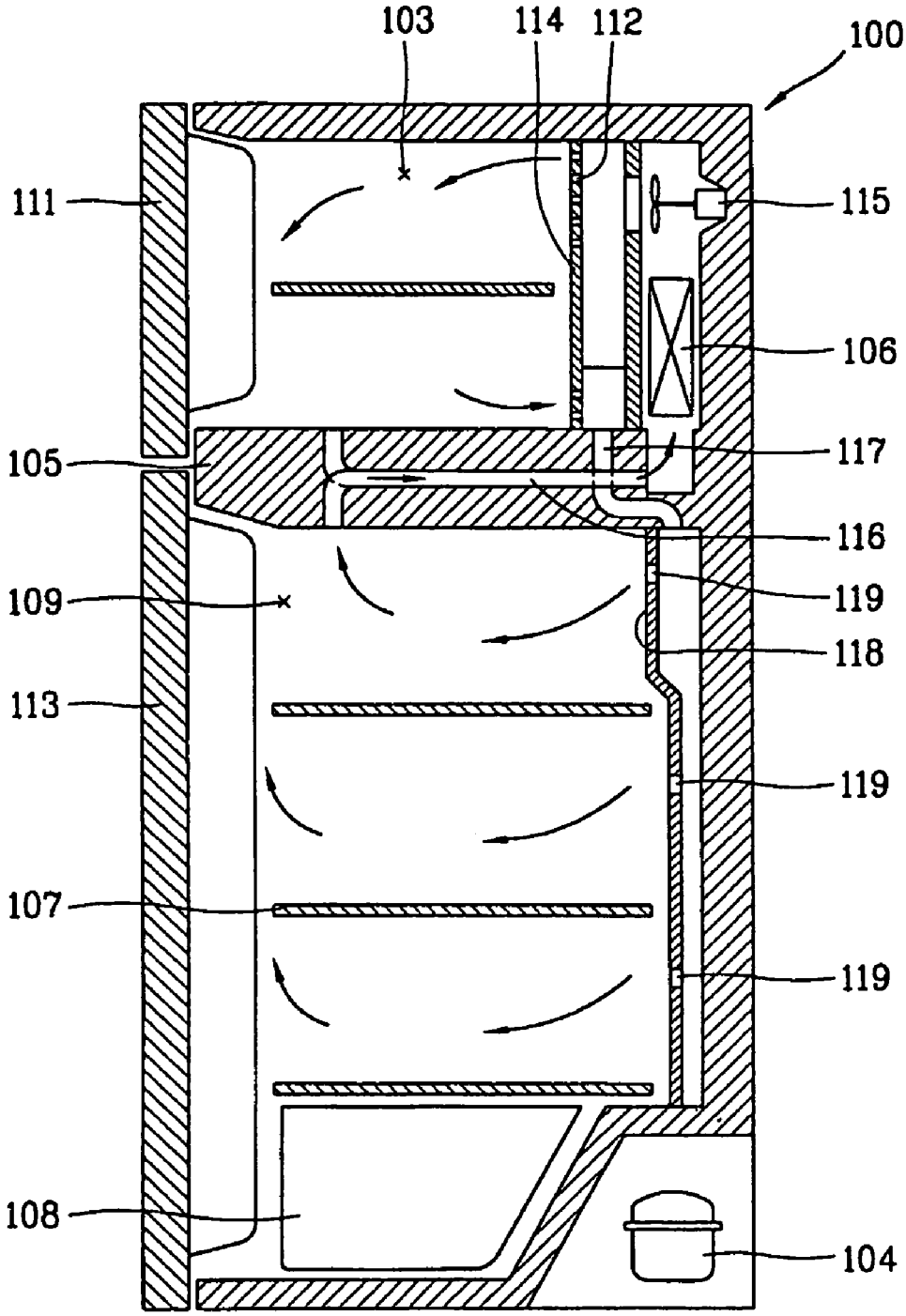
FIG. 1 is a vertical-sectional view showing a refrigerator in accordance with a conventional art.
Figure 2:
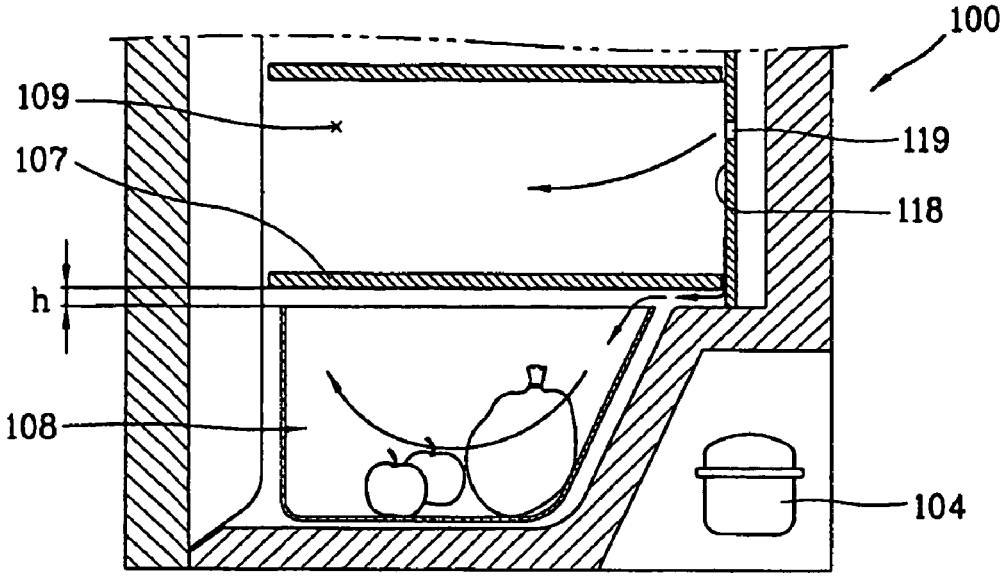
FIG. 2 is a vertical-sectional view showing a vegetable room of the refrigerator in accordance with the conventional art.
Figure 3:
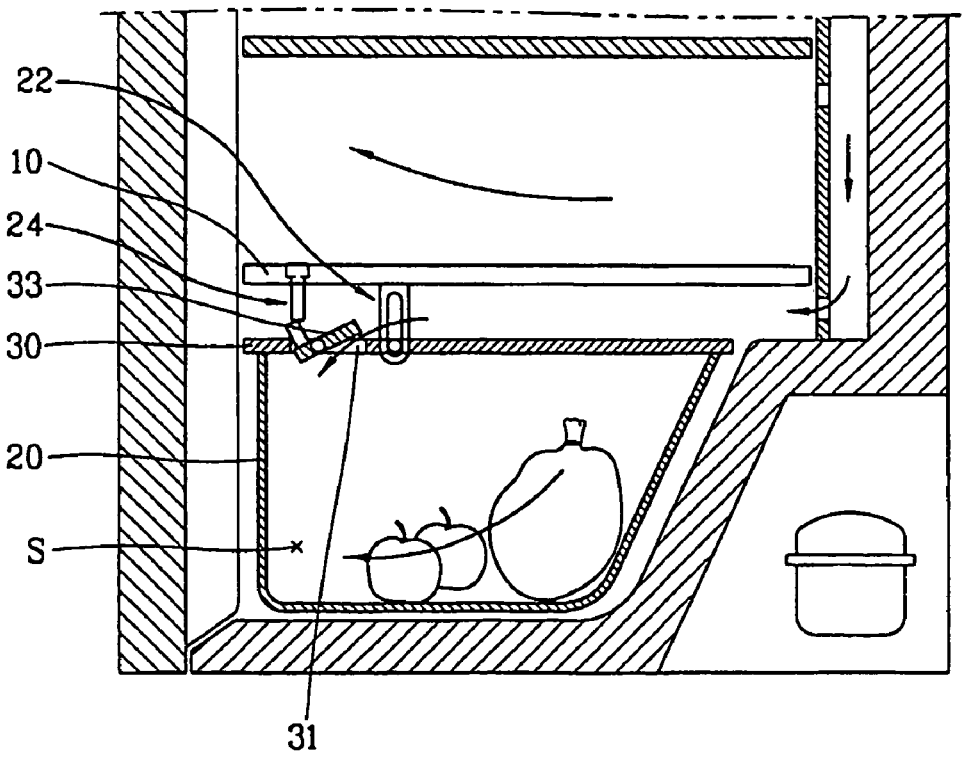
FIG. 3 is a vertical-sectional view showing a vegetable room of the refrigerator in accordance with the present invention.
Figure 4:
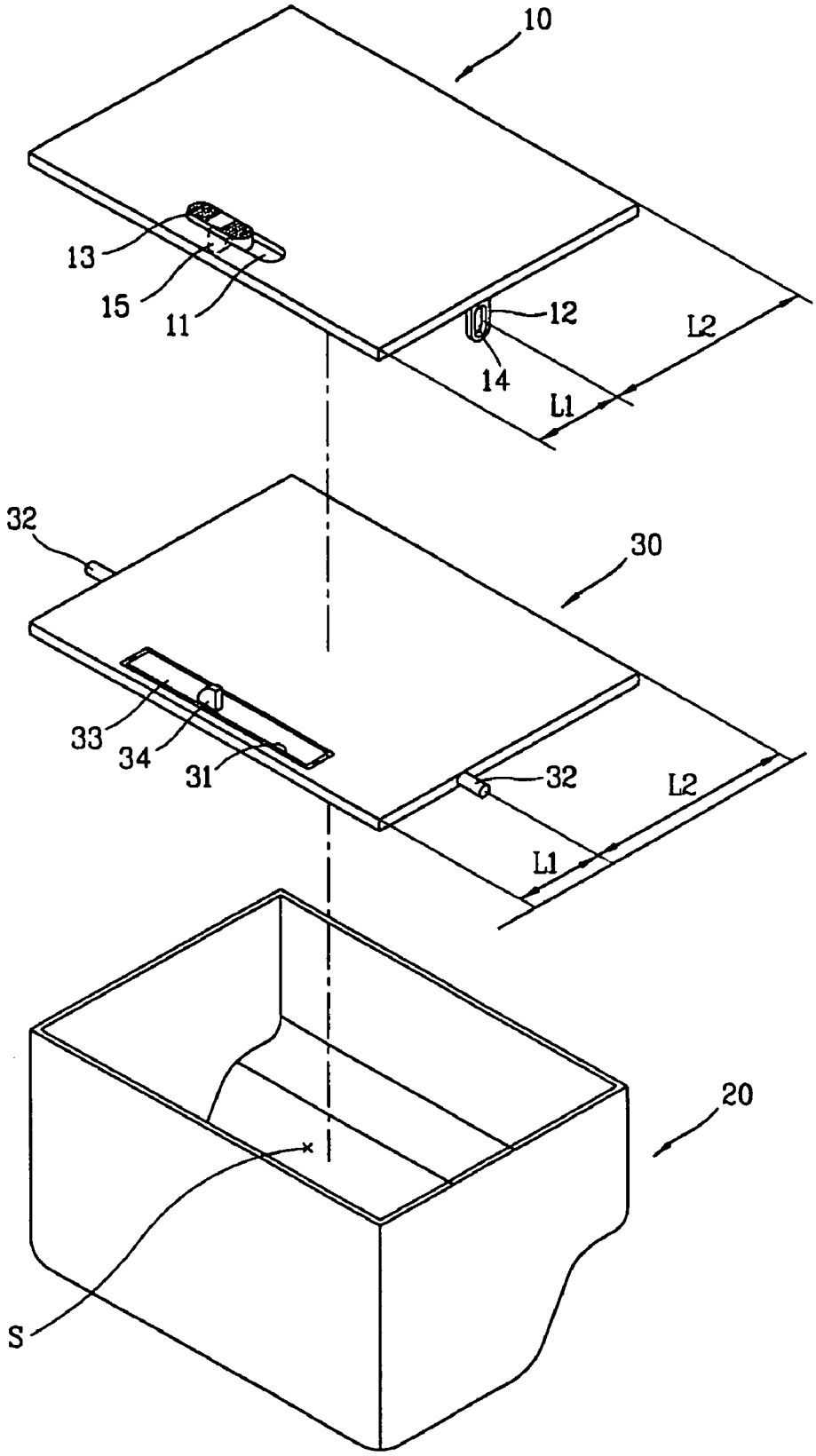
FIG. 4 is an exploded perspective view showing the vegetable room of the refrigerator in accordance with the present invention.

FIG. 3 is a vertical-sectional view showing a vegetable room of the refrigerator in accordance with the present invention, and FIG. 4 is an exploded perspective view showing the vegetable room of the refrigerator in accordance with the present invention.

As shown in FIGS. 3 and 4, the vegetable room for a refrigerator in accordance with the present invention includes: a vegetable box 20 provided at a lower side of a shelf 10 for receiving food items inside a refrigerating chamber, and formed with a receptacle space (S) of a certain volume opened upwardly so as to receive fruits, vegetables or functional storage items; a box cover 30 for covering the opening side of the vegetable box 20 to close the receptacle space (S) of the vegetable box 20 and having a cooling air ventilating hole 31 formed at one side thereof to allow cooling air to be introduced into the receptacle space (S); a cover support unit 22 interposed between the shelf 10 and the box cover 30 and supporting the box cover 30 at the lower side of the shelf 10; and a cooling air opening and closing unit 24 interposed between the shelf 10 and the box cover 30 and opening and closing the cooling air ventilating hole 31 of the box cover 32.

Figure 5:
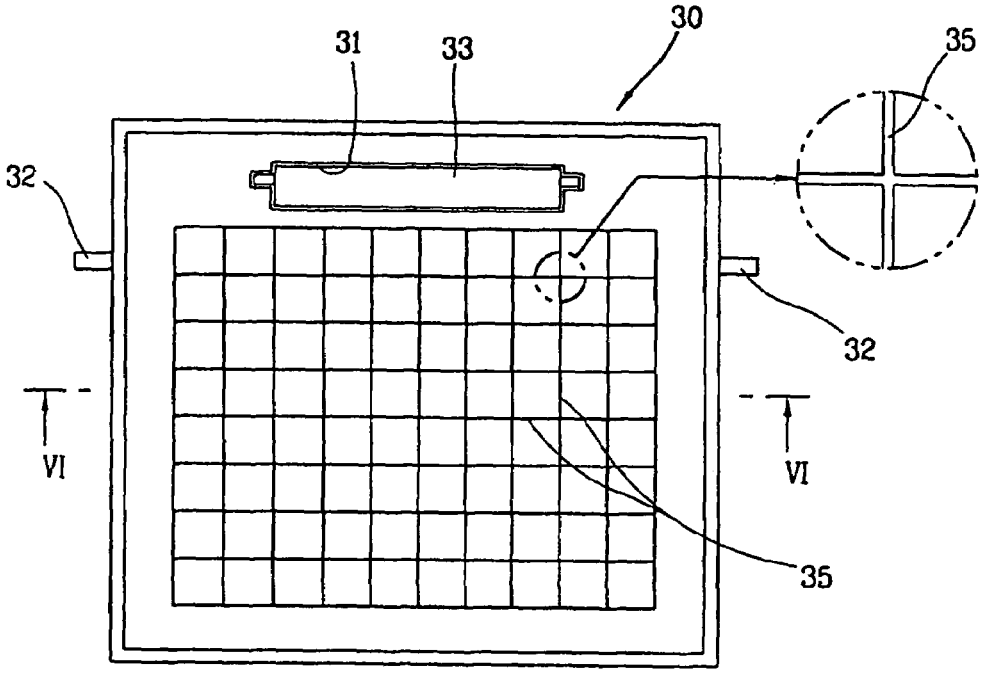
FIG. 5 is a plan view showing the bottom of a box cover of the refrigerator room of the refrigerator in accordance with the present invention.

As shown in FIG. 5, the box cover 30 is formed in a square panel shape like the shelf 10 by using a transparent and light material.

Figure 6:
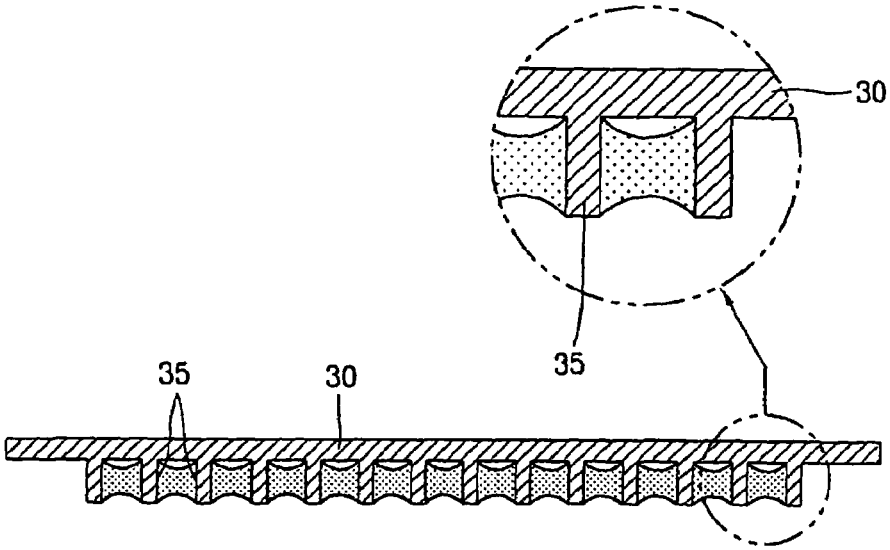
FIG. 6 is a sectional view taken along line VI-VI of FIG. 5.

As shown in FIG. 6, preferably, a plurality of ribs 35 are formed at a lower side of the box cover 30 to collect moisture existing in the vegetable box 20. The rib 35 has a grid form with a certain width and height so as to heighten a water-collection effect. As moisture existing inside the vegetable box 20 is collected at the grid, it is prevented from being discharged outwardly from the vegetable box 20.

The cover support unit 22 consists of a hinge bracket 12 extended downwardly from both left and right sides of the shelf 10 and having a hinge hole 14 formed long in the vertical direction, and a hinge shaft 32 formed extended both left and right sides of the box cover 30 and being movably inserted vertically into the hinge hole 14 of the hinge bracket 12.

The cover support unit 22 is preferably formed eccentric toward the front side on the basis of the center of the box cover 30 so that when the vegetable box 20 is separated from the lower side of the shelf 10, the box cover 30 is somewhat lifted at its front side compared to the rear side owing to the self-weight.

In other words, as shown in FIG. 4, the hinge bracket 12 and the hinge shaft 32 are positioned such that a distance L1 from the front side of the shelf 10 and the box cover 30 is shorter than a distance (L2) from the rear side of the shelf 10 and the box cover 30.

Meanwhile, though not shown in the drawing, the hinge bracket 12 may be formed at the box cover 30, and accordingly, the hinge shaft 32 may be formed at the shelf 10.

Figure 7:
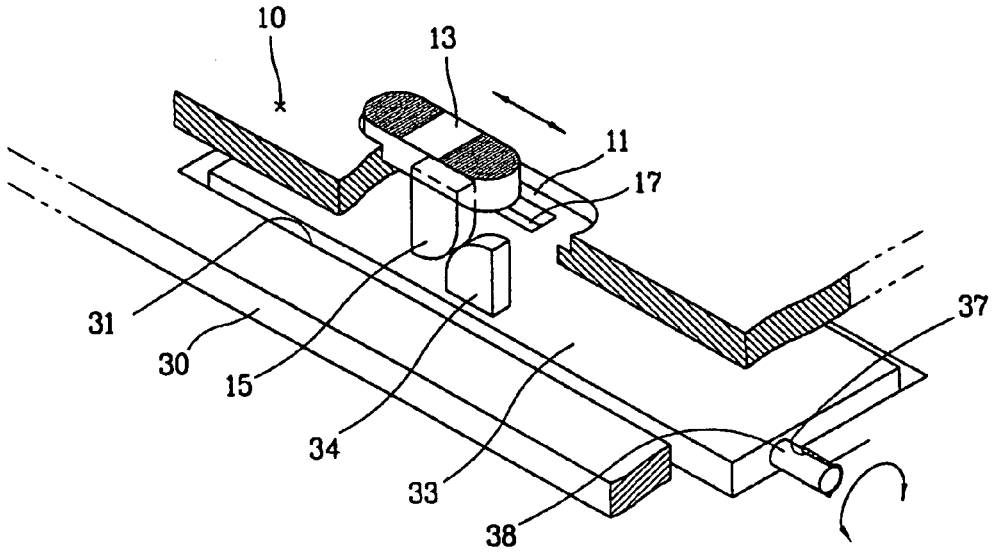
FIG. 7 is a partial perspective view showing a cooling air opening and closing unit of the vegetable room of the refrigerator in accordance with the present invention.
Figure 8:
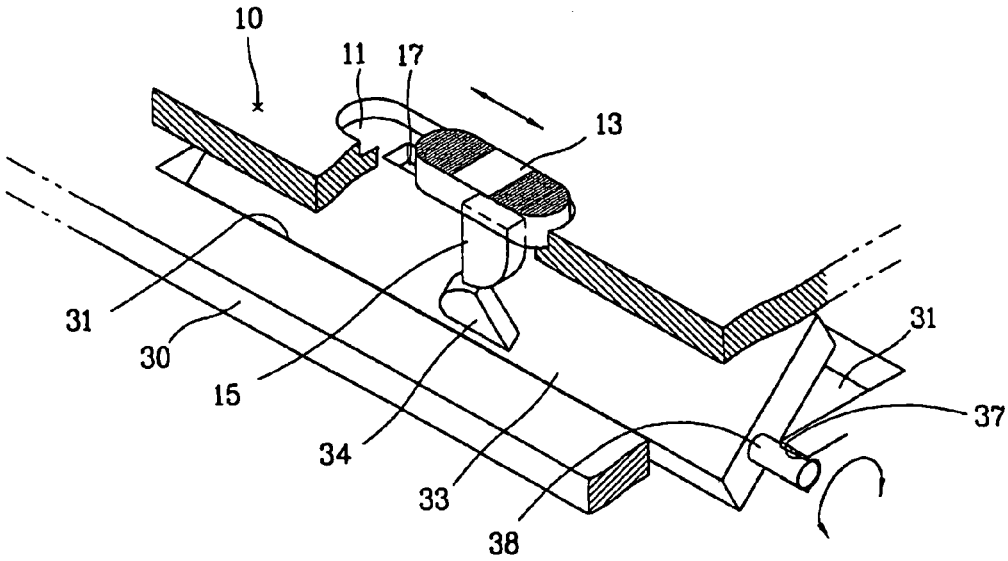
FIG. 8 is a partial perspective view showing how the cooling air opening and closing unit is operated in the vegetable room of the refrigerator in accordance with the present invention.

With reference to FIGS. 7 and 8, the cooling air opening and closing unit 24 includes an opening and closing member 33 rotatably fixed at the cooling air ventilating hole 31 of the box cover 30 and opening and closing the cooling air ventilating hole 31 while being rotated; a first protrusion 34 formed protruded upwardly of the opening and closing member 33; a knob 13 installed to be movable linearly at one side of the shelf 10; and a second protrusion 15 formed protruded downwardly of the knob 13 and rotating the opening and closing member by interacting with the first protrusion 34 when the know 13 is moved.

The cooling air opening and closing unit 24 is preferably installed at a front side near the refrigerator door in consideration of a users' convenience in operation, or otherwise, can be installed at a rear side of the refrigerator without being limited thereto.

The opening and closing member 33 is formed platy with a certain width and thickness and formed long about perpendicular to a direction that cooling air is introduced in order to allow cooling air to be smoothly introduced into the vegetable box 20.

The opening and closing member 33 includes a cylindrical support shaft 38 at both sides thereof which is rotatably inserted into an insertion hole 37 formed at both sides of the cooling air ventilating hole 31 and rotatably supports the opening and closing member 33 at the inner side of the cooling air ventilating hole 31.

Figure 9:
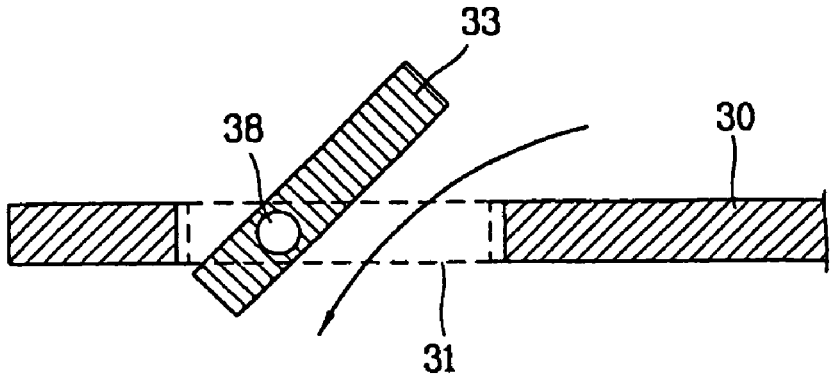
FIG. 9 is a partial sectional view showing a cooling air ventilating hole and opening and closing member in the vegetable room of the refrigerator in accordance with the present invention.
Figure 10:
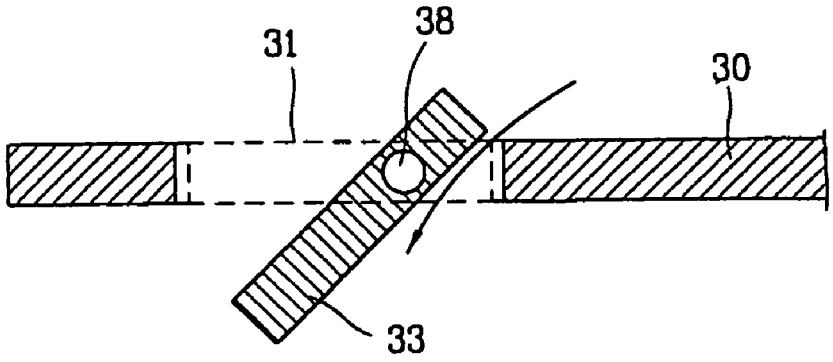
FIG. 10 is a vertical-sectional view showing the cooling air ventilating hole and opening and closing member in the vegetable room of the refrigerator in accordance with the present invention.

As shown in FIGS. 9 and 10, the support shaft 38 is formed eccentric to the front side or to the rear side on the basis of the center so that the cooling air ventilating hole 31 is opened by rotation of the opening and closing member 33 and closed by a self weight of the opening and closing member 33.

Meanwhile, a guide groove 11 is formed at the shelf 10 to guide a linear movement of the knob 13, and a guide slot 17 is formed at the inner side of the guide groove 11 to allow the second protrusion 15 to pass through the shelf 10 and guides a linear movement of the second protrusion 15.

The first protrusion 34 converts the linear movement of the knob 13 into a rotational movement of the opening and closing member 33 by interacting with the second protrusion 15. The first protrusion 34 is formed inclined at a certain angle toward the second protrusion 15 so that it can rotate the opening and closing member 33 by being pushed by the second protrusion 15.

Preferably, the first protrusion 34 and the second protrusion 15 have a curved shape with a certain curvature at portions where they are mutually contacted with each other so that they can be smoothly slid.

The operation and effect of the vegetable room of the refrigerator in accordance with the present invention will now be described.

Food items containing moisture such as fruits or vegetables or storage stuffs desired to be maintained in a dry state are stored in the receptacle space (S) of the vegetable box 20. In order to maintain the freshness of such food items and storage stuffs at the maximum, characteristics of each storage stuff should be preserved harmoniously through the following manipulation.

To begin with, the process of mounting the box cover 30 at the upper portion of the vegetable box 20 to close the receptacle space (S) of the vegetable box 20 in order to prevent the food items inside the vegetable box 20 from directly contacting with cooling air inside the refrigerator and with outdoor air of the refrigerator will now be described with reference to FIGS. 11A to 11C.

First, food items are put in the receptacle space (S) of the vegetable box 20 and the vegetable box 20 is inserted into the lower side of the shelf 10.

Figure 11A:
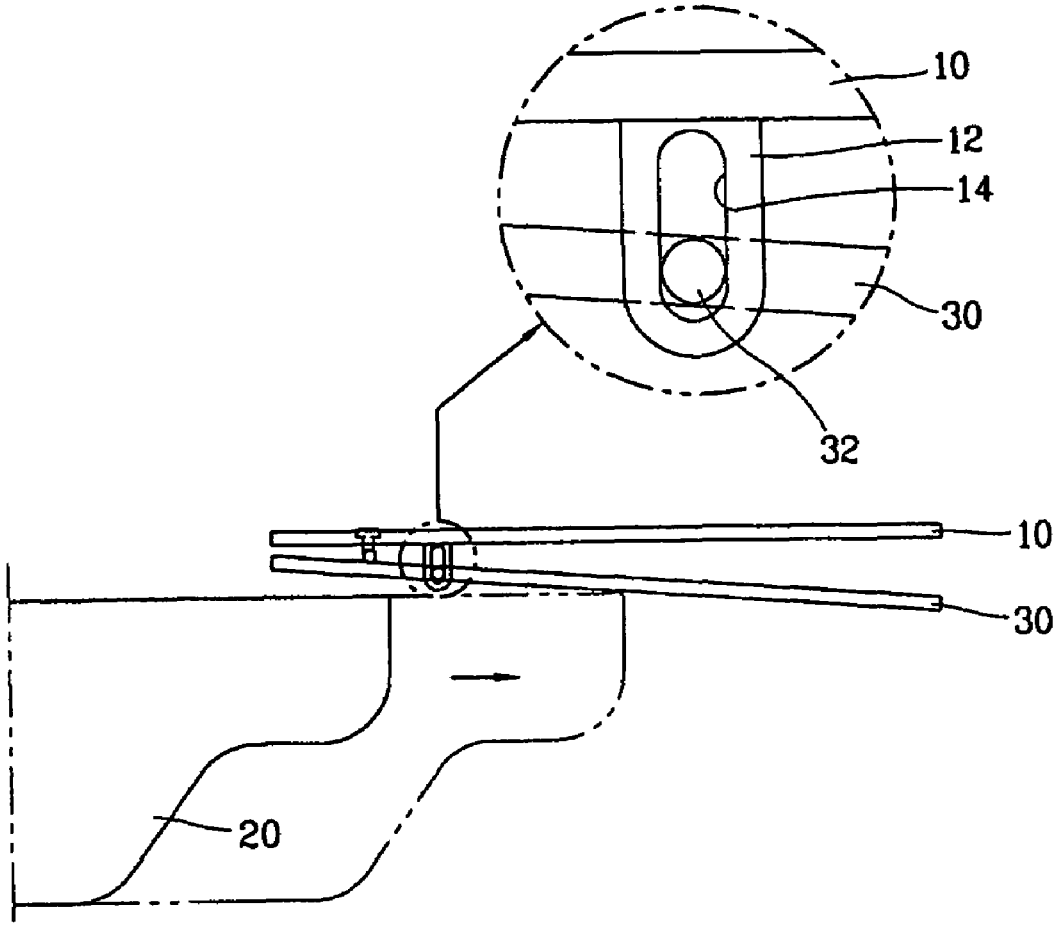
FIGS. 11A and 11C illustrate a sequential process of mounting a box cover at a vegetable box in the vegetable room of the refrigerator in accordance with the present invention.
Figure 11B:
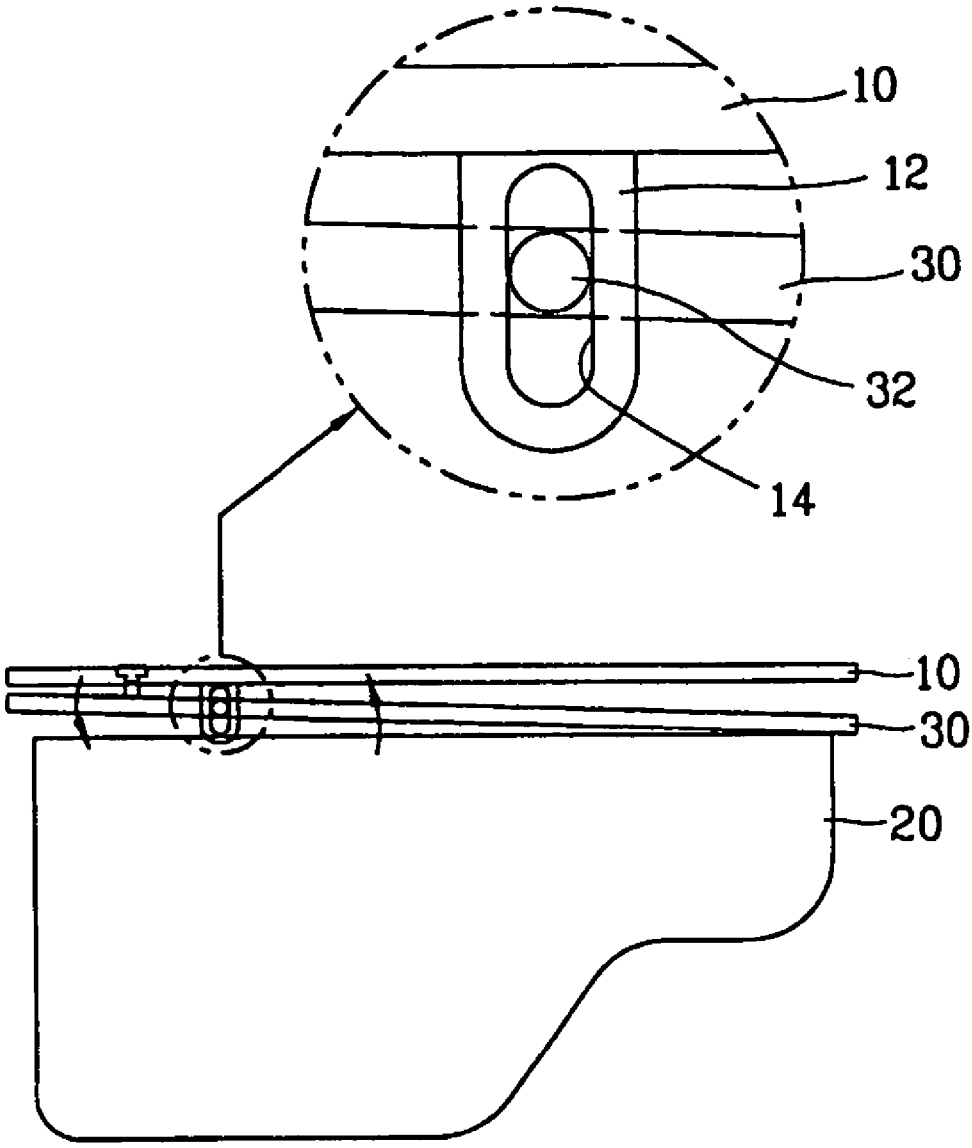

As shown in FIG. 11A, before the vegetable box 20 is inserted into the lower side of the shelf 10, the box cover 30 is inclined with its front side lifted. At this time, the vegetable box 20 is advanced until an upper end corner of the rear side of the vegetable box 20 is in contact with the rear side of the box cover 30. Then, as shown in FIG. 11B, the hinge shaft 32 provided at both sides of the box cover 30 is moved upwardly along the hinge hole 14 formed at the hinge bracket 12 provided at both sides of the shelf 10 and rotated such that the front side of the box cover 30 descends and the rear side thereof is lifted.

Figure 11C:
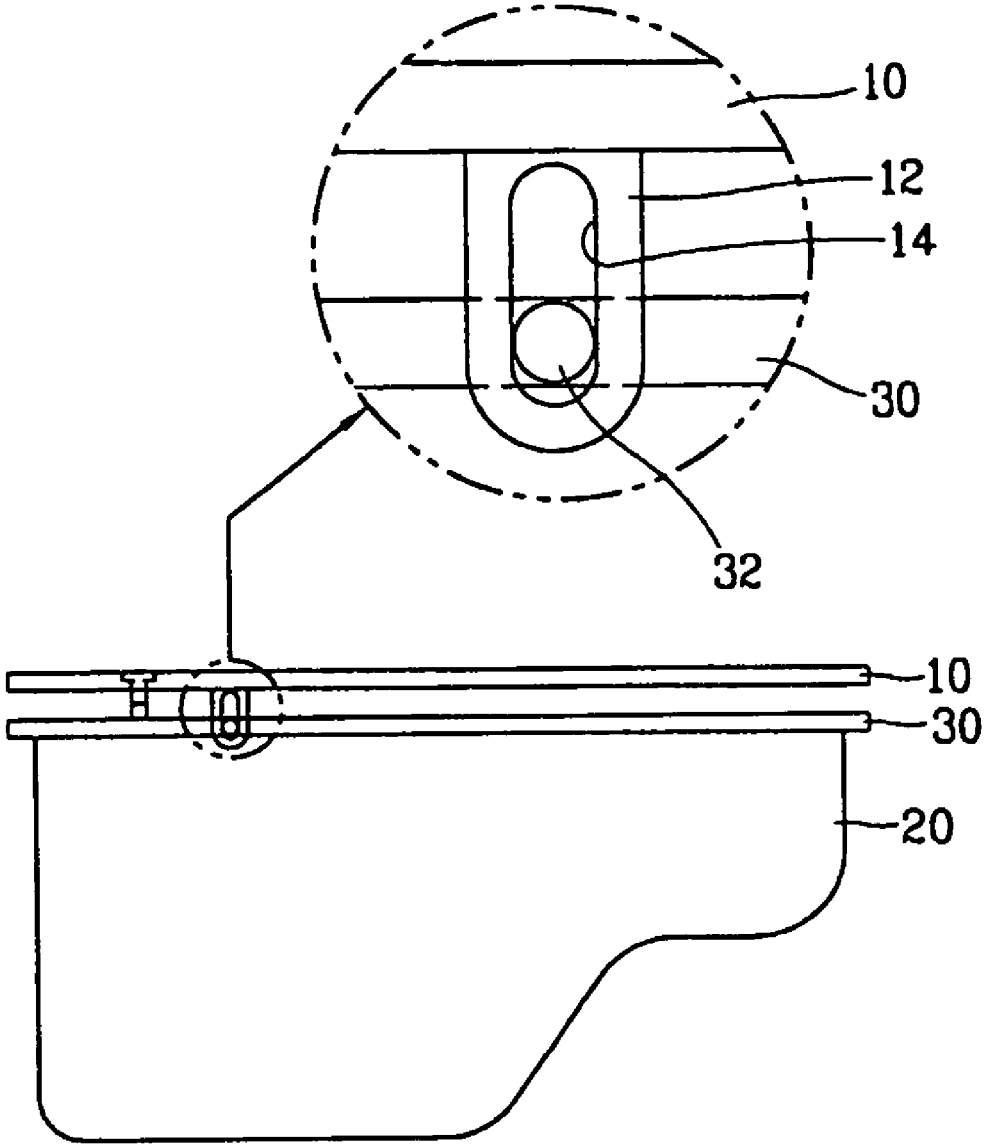

And then, as shown in FIG. 11C, after the vegetable box 20 is placed at a proper position of the lower side of the shelf 10, the box cover 30 descends to be mounted at an upper side of the vegetable box 20.

Accordingly, the receptacle space (S) of the vegetable box 20 is closed as the box cover 30 is mounted at the upper surface of the vegetable box 20, and thus, the food items stored in the receptacle space is prevented from directly contacting with cooling air circulating inside the refrigerator and at the same time outdoor air outside the refrigerator is prevented from being introduced thereinto and affecting the food items when the refrigerator door is opened and closed.

Meanwhile, if a condition outside the refrigerator is humid and the refrigerator door is opened and closed, when a food item is put into the vegetable box 20, the humid air is bound to be introduced into the vegetable box 20 together with the food item.

At this time, if a storage stuff preserved in the vegetable box 20 is in need of drying, since the vegetable box 20 is in a closed state by means of the box cover 30, the moisture introduced into the vegetable box 20 will not be discharged outwardly from the vegetable box 20 and cooled therein, making the storage stuff which needs drying to be damp.

In such a case, cooling air is let to be introduced into and circulated in the vegetable box 20 so as to take moisture away from the vegetable box 20 and discharge it outwardly, thereby maintaining the storage stuff in a dried state.

When cooling air is desired to be introduced into the vegetable box 20, the cooling air ventilating hole 31 is opened, rather than detaching the box cover 30, process of which will now be described.

First, when the knob 13 installed at the shelf 10 is slid in an opening direction (that is, in the right direction in FIG. 7 or 8), the second protrusion 15 of the knob 13 pushes the curved face of the first protrusion 34 of the opening and closing member 33. Then, being pushed, the first protrusion 34 moved downwardly, and the opening and closing member 33 is rotated centering around the support shaft 38 extendedly formed at both sides thereof, thereby opening the cooling air ventilating hole 31.

As the cooling air ventilating hole 31 is opened, cooling air circulated in the refrigerator is introduced into the vegetable box 20 and discharges moisture from the vegetable box 20, so that the vegetable box 20 can be maintained dry.

When food items which need drying is preserved in the vegetable box 20, even if an environment outside the refrigerator is not humid, it is preferred that the cooling air ventilating hole 31 is opened.

Meanwhile, if a food item of which moisture needs to be maintained is preserved in the vegetable box, the cooling air ventilating hole 31 must be closed to prevent the food item from being dehumidified by cooling air.

The cooling air ventilating hole 31 is closed as follows. That is, when the knob 13 installed at the shelf 10 is slid in a closing direction (that is, in the left direction in FIG. 7 or 8), the opening and closing member 33 is rotated centering around the support shaft 38 due to its self weight, closing the cooling air ventilating hole 31 of the box cover 30.

Accordingly, the receptacle space of the vegetable box 20 is closed and introduction of cooling air to moisture-containing food items which need to maintain the moisture as it is, such as vegetables and fruits, is cut off. In this manner dehydration is prevented.

At this time, moisture may be taken away from the food items in the receptacle space, but since this moisture ascends and is collected at the rib 35 formed protruded at a lower side of the box cover 30, moisture leakage is prevented and thus the humidity of the food items can be effectively maintained.

As so far described, the vegetable room for a refrigerator in accordance with the present invention has many advantages.

That is, the box cover is provided to cover the opening side of the vegetable box and the cooing air ventilating hole is formed at the box cover and closed when vegetables or fruits are preserved. Accordingly, preserved in the hermetic state, those moisture-maintaining desired food items will not be in contact with cooling air, so that dehydration of them can be prevented.

Especially, when food items which needs drying are preserved under the condition of a humid environment outside the refrigerator, the cooling air ventilating hole is opened to allow cooling air to be in contact with the dry-kept food items in the vegetable box and continuously move moisture generated from the food items by means of cooling air, thereby maintaining the food items in the dry state. In this manner, the storage condition of food items preserved in the vegetable box can be optimized.

In addition, the cooling air ventilating hole can be simply opened and closed without detaching the box cover to introduce cooling air into the vegetable box or cut off cooling air with the vegetable box.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A vegetable room for a refrigerator comprising:

a vegetable box disposed inside a refrigerator in which cooling air is supplied and circulated and which a shelf for receiving food item is provided, having a receptacle space for receiving food items formed to be opened upwardly;

a box cover for covering an opening side of the vegetable box to close the receptacle space of the vegetable box and having a cooling air ventilating hole formed at one side thereof to allow cooling air to be introduced into the receptacle space;

a cooling air opening and closing unit for selectively opening and closing the cooling air ventilating hole of the box cover; and a cover support unit for connecting the box cover and the shelf so that the box cover can be supported at the lower side of the shelf.

2. The vegetable room of claim 1, wherein the cover support unit is formed eccentric toward the front side on the basis of the center of the box cover so that when the vegetable box is separated from the lower side of the shelf, the front side of the box cover is relatively lifted compared to the rear side thereof due to its self weight.

3. The vegetable room of claim 2, wherein the cover support unit comprises:

a hinge bracket extended downwardly from both left and right sides of the shelf and having a hinge hole formed therein; and a hinge shaft extended at both left and right sides of the box cover and inserted into the hinge hole so as to be movable vertically.

4. The vegetable room of claim 3, wherein the hinge hole is formed long vertically.

5. The vegetable room of claim 2, wherein the cover support unit comprises:

a hinge bracket extended upwardly from both left and right sides of the vegetable box and having a vertically long hinge hole formed therein; and a hinge shaft extended to both left and right sides of the shelf and inserted into the hinge hole so as to be movable vertically.

6. The vegetable room of claim 1, wherein the cooling air opening and closing unit comprises:

an opening and closing member rotatably fixed at the cooling air ventilating hole of the box cover;

a first protrusion formed protruded upwardly from the opening and closing member;

a knob installed to be movable linearly at one side of the shelf; and a second protrusion formed protruded downwardly from the knob and rotating the opening and closing member by interacting with the first protrusion when the knob is moved.

7. The vegetable room of claim 6, wherein the cooling air opening and closing unit is installed at a front side of the refrigerator.

8. The vegetable room of claim 6, wherein the cooling air opening and closing unit is installed at a rear side of the refrigerator.

9. The vegetable room of claim 6, wherein the opening and closing member is formed long approximately perpendicular to a direction that cooling air is introduced, in order to ensure a smooth introduction of cooling air into the vegetable box.

10. The vegetable room of claim 6, wherein the opening and closing member is formed with a certain thickness and provided with a cylindrical support shaft extended at both sides thereof, and the support shaft is rotatably inserted into insertion holes formed at both sides of the cooling air ventilating hole to allow the opening and closing member to be rotatably supported at the inner side of the cooling air ventilating hole.

11. The vegetable room of claim 10, wherein the support shaft is formed eccentric toward a front side or toward a rear side on the basis of the center of the opening and closing member so that the opening and closing member can close the cooling air ventilating hole by its rotation according to self weight.

12. The vegetable room of claim 6, wherein a guide groove is formed at the shelf to guide a linear movement of the knob.

13. The vegetable room of claim 12, wherein a guide slot is formed at the inner side of the guide groove to allow the second protrusion to pass through the shelf and guide a linear movement of the second protrusion.

14. The vegetable room of claim 6, wherein the first protrusion is formed inclined at a certain angle in order to rotate the opening and closing member by being pushed by the second protrusion.

15. The vegetable room of claim 6, wherein the first protrusion and the second protrusion respectively have a curved shape with a certain curvature at portions where they are mutually contacted with each other so that they can be smoothly slid.

16. The vegetable room of claim 1, wherein a plurality of ribs are formed at the bottom of the box cover with a certain height and with a certain width to collect moisture inside the vegetable box.

17. The vegetable room of claim 16 wherein the ribs have a grid form.

* * * * *